US005192822A

United States Patent [19]

Hoshino

[11] Patent Number: 5,192,822

[45] Date of Patent: Mar. 9, 1993

[54] HIGH HAT STAND PEDAL INITIAL HEIGHT ADJUSTMENT

[75] Inventor: Yoshiki Hoshino, Asahi, Japan

[73] Assignee: Hoshino Gakki Co., Ltd., Japan

[21] Appl. No.: 721,276

[22] Filed: Jun. 26, 1991

[30] Foreign Application Priority Data

Feb. 26, 1991 [JP] Japan ..... 3-16669[U]

[51] Int. Cl.[5] ..... G10D 13/00

[52] U.S. Cl. ..... 84/422.3; 84/421; 84/426; 84/DIG. 3; 84/DIG. 12

[58] Field of Search ..... 84/421, 422.3, 425, 84/426, DIG. 3, DIG. 12

[56] References Cited

U.S. PATENT DOCUMENTS

| | | | |
|---|---|---|---|
| 3,930,431 | 1/1976 | Magadini | 84/422.1 |
| 4,449,440 | 5/1984 | Hoshino | 84/422.3 |
| 4,517,876 | 5/1985 | Duhon | 84/421 |
| 4,898,062 | 2/1990 | Hoshino | 84/422.3 |
| 4,905,565 | 3/1990 | Hoshino | 84/422.3 |

*Primary Examiner*—William M. Shoop, Jr.

*Assistant Examiner*—Heien Kim

*Attorney, Agent, or Firm*—Ostrolenk, Faber, Gerb & Soffen

[57] ABSTRACT

A foot pedal initial height adjustment for the foot pedal of a high hat stand. The foot pedal operates an operating rod which moves the movable cymbal down to contact the stationary cymbal. A spring biases the movable cymbal, its operating rod and the pedal upwardly. A connecting element in the form of a lever or wheel is connected on the one hand with the pedal and at a spaced away location is connected on the other hand with a pedal height adjusting member. The connecting element is also connected to the stationary body of the stand. The pedal height adjusting member is adjustable in length, e.g., by being comprised of two toothed rack holding arms whose relative overlapping lengths is adjustable. The adjustment of the length of the pedal height adjusting member determines the initial position and orientation of the connecting element which sets the initial height of the pedal, before the movable cymbal is moved toward the stationary cymbal.

13 Claims, 7 Drawing Sheets

HIGH HAT STAND PEDAL INITIAL HEIGHT ADJUSTMENT

BACKGROUND OF THE INVENTION

The invention relates to a high hat stand and particularly to enabling adjustment of the initial height of the movable cymbal operating foot pedal, that is, the distance between the pedal and the upper cymbal, at the time of a performance.

A lower fixed cymbal and an upper movable cymbal are arranged in the upper part of a high hat stand. As the foot pedal at the lower part of the stand is moved typically downward, the upper movable cymbal of the stand is moved correspondingly downward vertically by the operating rod connected between the pedal and the upper movable cymbal, with the musical performance being carried out as the movable cymbal contacts the lower fixed cymbal and is opened away from it. Since the operating rod of the upper movable cymbal is normally given an upward bias by a spring, the performer controls the movable cymbal by stepping on the pedal and lowering it, which moves the upper cymbal down, or by loosening the step on the pedal, which permits the spring to raise the upper cymbal and the pedal. Examples of such a high hat stand are disclosed in U.S. Pat. Nos. 4,898,062 and 4,905,565 and U.S. application Ser. Nos. 773,985 and 574,277, both filed on Aug. 28, 1990.

In this kind of high hat stand, quick and accurate operation or highly responsive operation of the movable cymbal is required to accurately express the will of the performer. This responsiveness is sought through the pedal that moves the cymbal operating rod being capable of being stepped in lightly and of returning quickly. As the operating rod has a normal upward bias provided by a spring, the spring should be weak in order for the pedal to be stepped in lightly. In order for the rod and pedal to return quickly, on the other hand, the spring should be strong. These two requirements are mutually contradictory.

In addition, the performance requires a mechanism that permits a delicate opening and closing of the cymbals, wherein the cymbals can be slightly opened or closed by a delicate pedal operation, and wherein the cymbals are tightly closed when they are in the closed state.

For example, the prior high hat stand of FIG. 7 has a cymbal operating rod 100 and a foot pedal 110 which are directly connected to each other. As a result, the travel distance of the free end of the foot pedal 110 corresponds to the travel distance of the cymbal operating rod, and a force of the same value as the spring pressure of the spring device 105 is required for stepping in the foot pedal 110.

A connective member 106 joins the spring of the spring device and the operating rod to supply a bias to the rod. A chain 107 connects the connective member 106 with the foot pedal 110.

In addition, the starting, undepressed height of the pedal vertically should be variable, depending upon the convenience of the performer or the form of the performance. However, few high hat stands include a mechanism for adjusting the initial height of the foot pedal. In the case where the high hat is used with a drum set having two bass drums or a drum set having a twin pedal, the heights of the pedal plates of the high hat stand and of the bass drum that is arranged alongside it may be uneven, which may inconvenience the performer, or it may be difficult to set the height difference at a height differential that is convenient to the performer, which inhibits a good performance.

SUMMARY OF THE INVENTION

The invention provides a high hat stand which is highly responsive. It is operable by connection of the pedal plate and the movable cymbal operating rod through an operating member, like a lever or a wheel member, etc., that uses the principle of a lever and that provides a pedal height adjustment for the operating rod with respect to the main body of the high hat stand. The movable cymbal operating rod can be moved vertically by vertical movement of the foot pedal.

The height of the pedal is freely adjustable. The foot pedal and the movable cymbal operating rod are connected through a connecting element, like a lever and/or a wheel, wherein the connecting element is connected with the pedal to be moved by the performer and with a pedal height adjusting member. The connection of the connecting element to the pedal height adjusting member is spaced away from the connection of the connecting element to the pedal. The connecting element is further connected to the main body of the high hat stand and/or to the stationary cymbal, both of which are stationary. Adjustment of the pedal height adjusting member, and particularly adjustment of its length, determines the position of the connecting element lever or wheel and thereby determines the initial height of the pedal before the pedal is operated to move the movable cymbal toward the stationary cymbal.

Other objects and features of the invention are described in the following text and the accompanying drawings.

DESCRIPTION OF THE PREFERRED EMBODIMENTS

Figure 1:
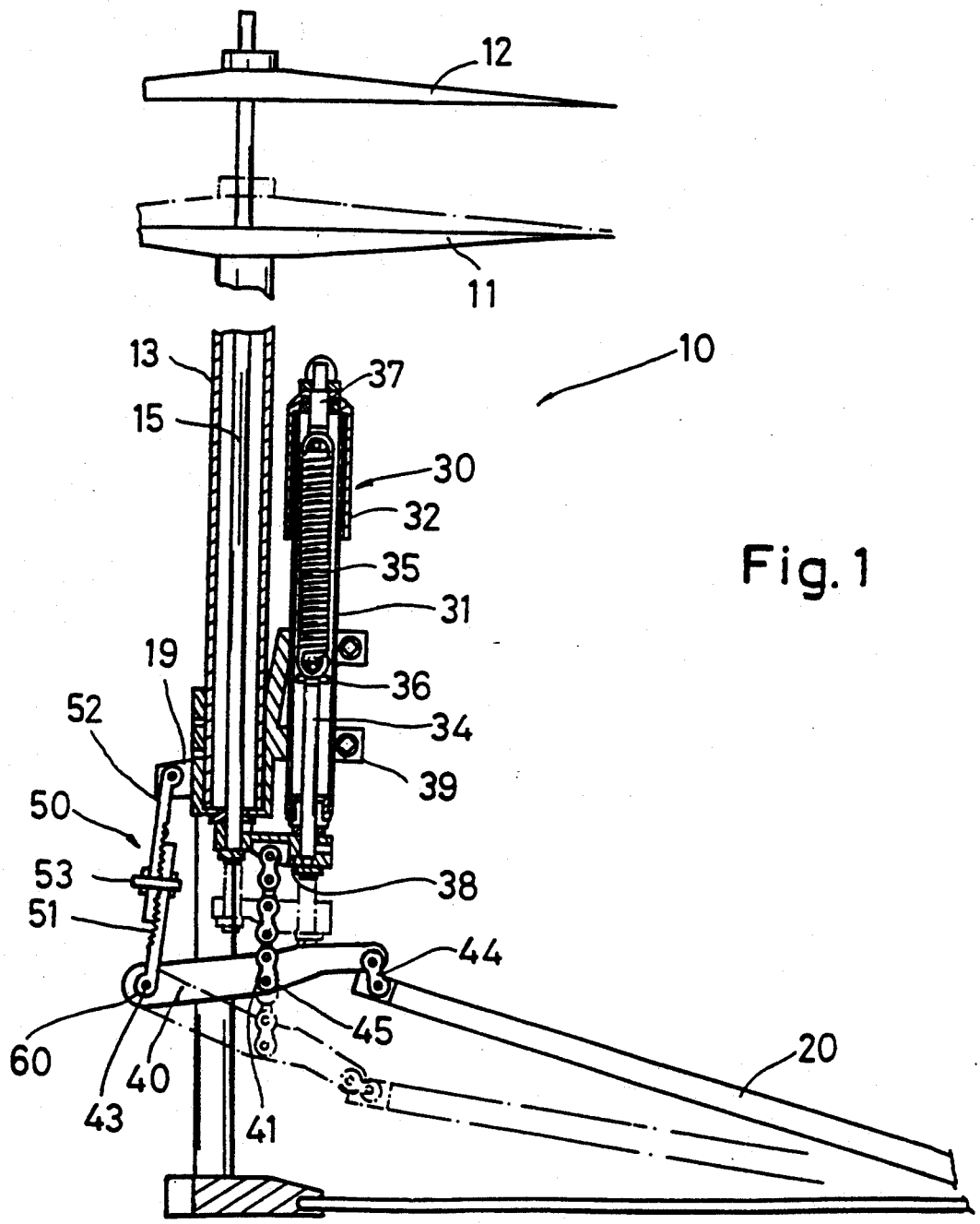
FIG. 1 is a cross-section through a high hat stand according to the invention, with a part omitted.

A high hat stand including the invention is explained with reference to FIG. 1. A lower, upwardly facing, fixed cymbal 11 and an upper, downwardly facing, movable cymbal 12 are arranged in the upper part of a high hat stand 10. The lower fixed cymbal 11 is fixed to the stationary main pipe body 13 of the stationary stand. The upper movable cymbal 12 is installed on a cymbal operating rod 15 that passes freely through the main pipe body 13. The cymbal 12 is moved vertically along with the vertical movement of its operating rod 15 in the main pipe body 13, being moved downward for closing the cymbal 12 with the lower fixed cymbal 11 and moving upward for opening them apart.

The operating rod 15 of the upper movable cymbal 12 is given a normal, continuous upward bias by a spring device 30. Device 30 has a main tubular part 31. An adjusting cap 32 is screwed on the top of the part 31. A spring 35 is held freely expandably and adjustably between a lower spring receiving member 36 provided at the lower part of the main tubular body 31 and an upper spring receiving member 37 provided on the adjusting cap 32. Screwing the cap 32 tighter or looser adjusts the spring tension.

The main body of the spring device 30 is installed on the main pipe body 13 by a bracket 39. The rod part 34 of the lower spring receiving member 36 is connected to the operating rod 15 through a connective member 38, thereby giving the operating rod 15 its normal bias. In the alternative, the spring that upwardly biases the operating rod 15 may be directly wound on the operating rod 15 inside the main pipe body 13.

Figure 2:
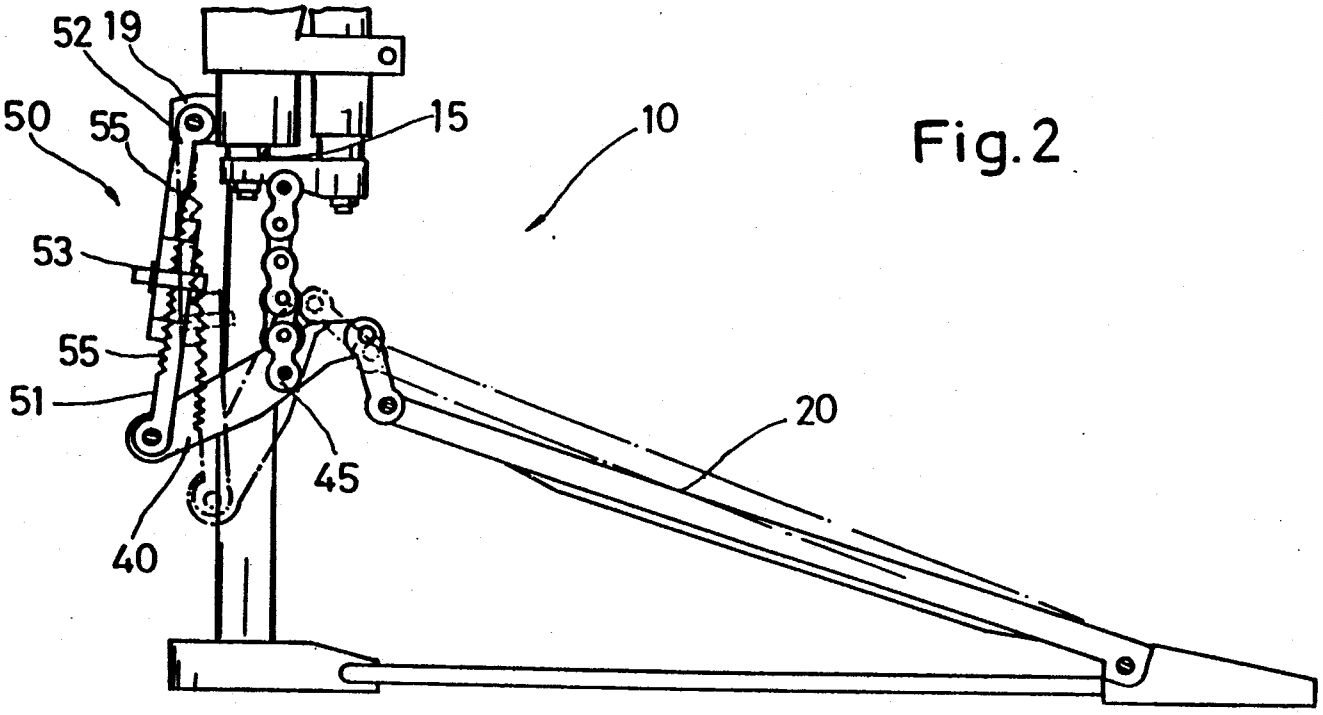
FIG. 2 is an expanded cross-section of an essential part.

As shown in FIG. 1 and FIG. 2, for example, a foot pedal 20 is pivotably supported to the body of the stand at its rear end. The free front end of the pedal is pivotably connected to the movable cymbal operating rod 15 through a swingable lever 40, which is a connecting element. The free, front tip of the lever 40 is connected with the protrusion 19 on the main stand body by an adjusting member 50, described below. A connective chain 44 connects the free front end of the foot pedal 20 to the rear end of the lever 40.

A connective part 45 that operates the movable cymbal operating rod 15 is formed in the lever 40. Since the operating rod 15 and the spring device 30 are connected by a connective member 38, the lever 40 is also connected to the connective member 38. A chain 41 connects the lever 40 at 45 with the connective member 38.

The lever 40 has a front tip away from the pedal 20 that serves as a fulcrum 60. That fulcrum 60 is freely rotatably fixed to the lower end of the adjusting member 50 by an installation pin 43. When a performer steps on the foot pedal 20, this causes vertical movement with the fulcrum 60 as the center for vertically moving the operating rod 15.

Setting of the location of the connective part 45 which connects with the operating rod 15 in the lever 40 becomes quite important. The connective part 45 serves as a point of action of the lever, with the size of the working force between the pedal 20 and the cymbal 12 being varied by selection of that location. In this device, it is believed that practical and easy use is obtained when the distance between the fulcrum 60 and the connective part 45 is approximately in the range between 0.5 and 0.7 units of length when the length of the lever is one unit of length.

In the embodiment of FIGS. 1 and 2, the adjusting member 50 is comprised of a pedal side adjusting member 51 having a lower end which is journaled on the forward end of the lever 40, a main body side adjusting member 52 having an upper end which is journaled on the protrusion 19 of the stationary main stand body and a stopper metal 53 which connects the members 51 and 52.

The pedal side adjusting member 51 and the main body side adjusting member 52 each have cooperating engageable teeth in a respective rack 55 that adjusts the length of the member 50 by selection of the overlapping length portions of the racks 55 at which they are mutually engaged. The performer can set the foot pedal 20 at a desired height by engaging the adjusting racks 55 to set the desired length of the adjusting member and by then fixing the racks together with the stopping metal 53.

As is shown by the dash-dot line in FIG. 2, the length of the adjusting member 50 can be increased by reducing the number of rack teeth that are engaged. Therefore, the initial height of the pedal is set when the lever 40 is rotated at the connective part 45 with the operating rod 15 as the center. As a consequence, the right end of the lever 40 is pulled up, and the foot pedal 20 is raised.

Figure 3:
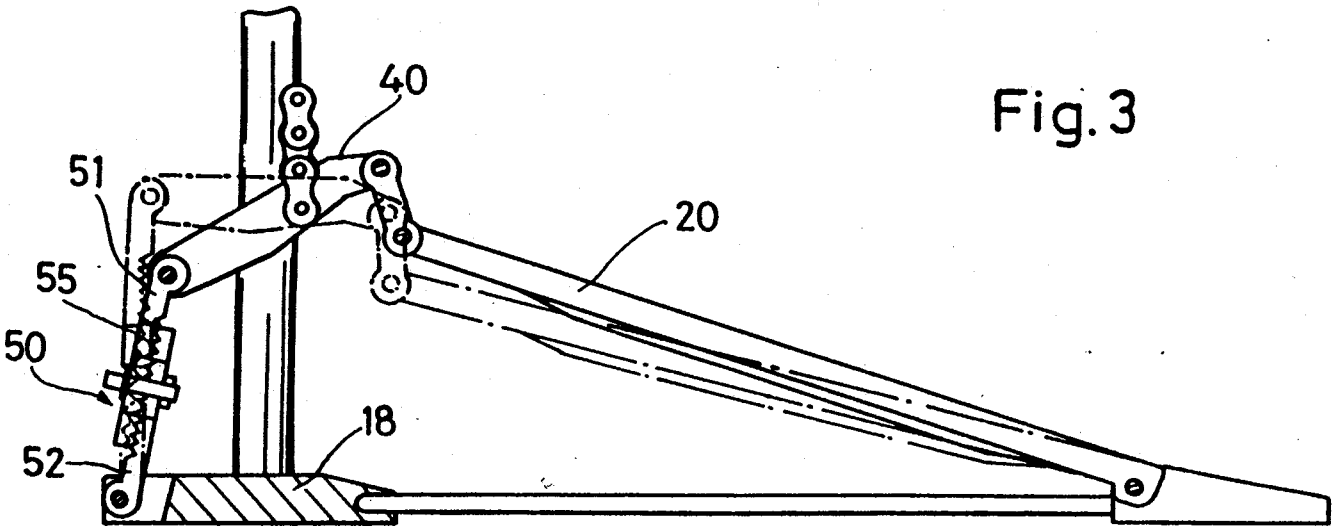
FIG. 3 is an expanded cross-section of the essential part of a second embodiment.

FIG. 3 shows a second embodiment where the main body side adjusting member 52 is journaled to the front of the stationary base stand part 18, whereby as in the first embodiment, that member 52 is held to the stationary part of the stand. The right edge or pedal side of the lever 40 is lowered and the foot pedal 20 height is pushed downward as the lengths of the engaged portions of the racks 55 is reduced, which lengthens the adjusting member. As in the first embodiment, there is a chain connection between the lever 40 and the connective member 38.

Figure 4:
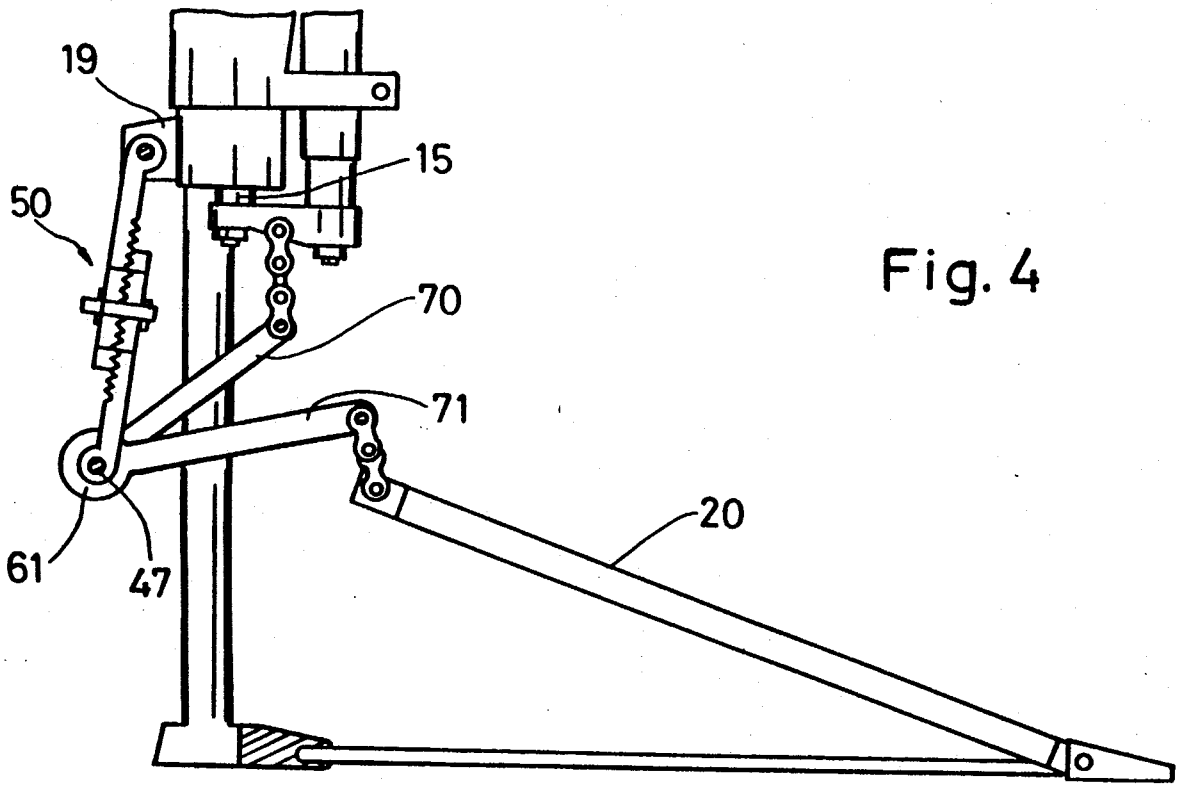
FIG. 4 is an expanded cross-section of the essential part of a third embodiment.

FIG. 4 shows a third embodiment with a short lever 70 that vertically moves the cymbal operating rod 15 and a long lever 71 that vertically moves with the foot pedal 20. The short lever 70 and the long lever 72 are attached together to function as one body, and their ends meet at a common fulcrum 61, which is the connecting element. That fulcrum 61 is connected with the main stand body protrusion 19 by an adjusting member 50. The lengths of the levers 70 and 71 are selected so that they together function like the one lever 40 of FIGS. 2 and 3.

An installation pin 47 links the short lever 70 and the long lever 71 to rotate together, with the fulcrum 61 at their center of rotation.

Figure 5:
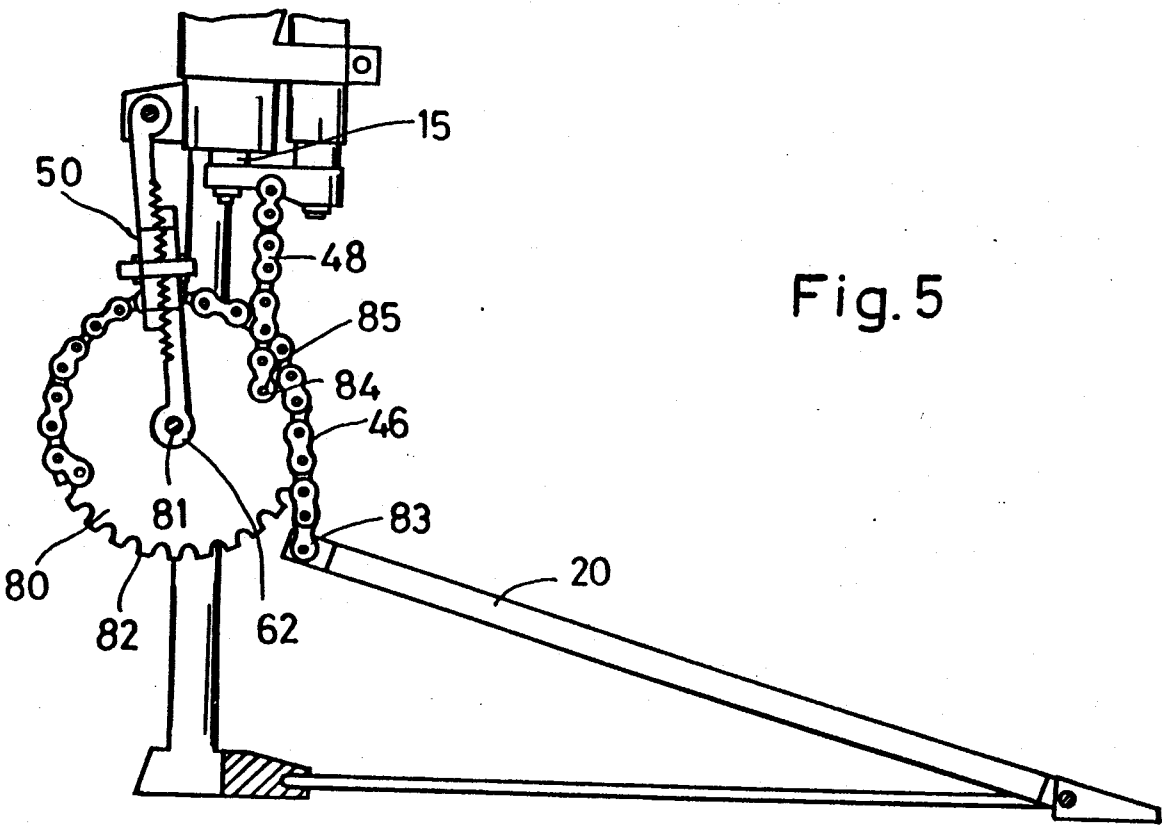
FIG. 5 is an expanded cross-section of the essential part of a fourth embodiment.

FIG. 5 shows a fourth embodiment where the operating rod 15 and the foot pedal 20 are connected through a connecting element in the form of a wheel member 80 comprising a sprocket or a partial sprocket. The wheel member 80 is connected with the main stand body, with an axial body 81 at the fulcrum 62 and with the height adjusting rack 50 installed on the fulcrum 62.

The wheel member 80 has a toothed periphery 82, which is wound over by the connective link chain 46 to the foot pedal 20, so that the wheel member rotates with the vertical movement of the foot pedal 20. A connective part 85 for the cymbal operating rod 15 is formed at a desired circumferential location radially inside the periphery of the wheel member 80. A connective link chain joins the rod 15 and the member 80. Connective pins 83 and 84 join the chains 46 and 48 to the pedal 20 and the wheel member 80, respectively. Again, the different radii to the periphery 82 and to the connective pin 84 are selected so that the chains 46 and 48 together function like the lever 40.

Figure 6:
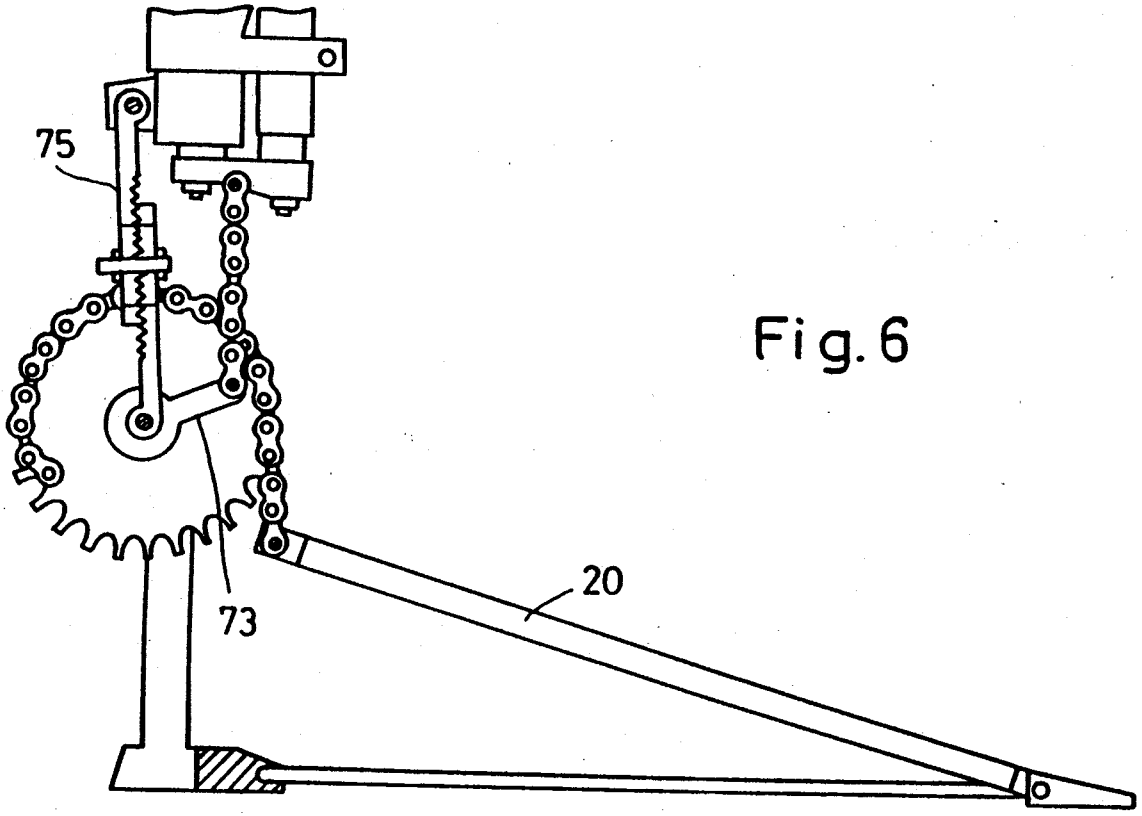
FIG. 6 shows an expanded cross-section of the essential part of a fifth embodiment.
Figure 7:
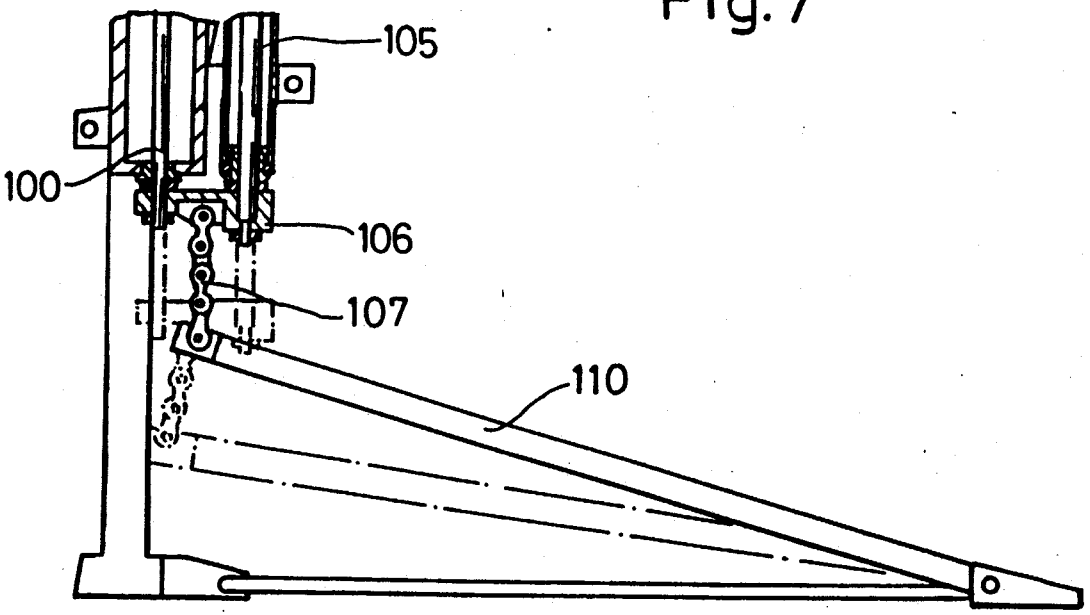
FIG. 7 is a cross-section of a high hat stand of the prior art.

FIG. 6 shows a fifth embodiment where the short lever 73 that is shown in FIG. 4 is combined with the wheel member 80 that is shown in FIG. 5, and which wheel member defines the longer lever arm. Again, as in FIGS. 4 and 5, the lever arm to the operating rod connection is shorter than the lever arm to the pedal connection, measured from their connection to a fulcrum at the center of the wheel.

The high hat stand of all of the above embodiments has superior effect because the cymbal operating rod and the foot pedal are connected through an operating member that uses the principle of the lever. Since it becomes possible to step in the pedal with a smaller force, the performer's feeling upon stepping on the conventional pedal is radically changed and the operability of the pedal is vastly improved. Because the amount of pedal motion can be made larger, as compared with the distance of movement of the operating rod, delicate movement of the movable cymbal becomes possible, with fine cymbal opening and closing motions becoming easy.

In addition, the pedal can be returned more quickly by the return spring, thereby even causing a sensation to the performer that the pedal sticks to the sole of the performer's foot. This offers a high hat stand with extremely high responsiveness, which satisfies the needs of the performer in a delicate fashion.

Because the connecting element is connected to the main stand body by means of a freely adjustable pedal height adjusting means, like the illustrated length adjustable rack connection, the performer can set a pedal height which is suitable to himself and in conformity with the form of his performance.

Even when the high hat stand is set up along with the pedal of, for instance, a bass drum, etc., it becomes easily possible to set the pedal height which is most convenient to the performer's performance. The high hat stand has unprecedented great advantages and strong points, as compared with conventional products.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A high hat stand with an adjustable height operating pedal comprising:

a stand; a stationary cymbal supported by the stand to be contacted; a movable cymbal movable into contact with and away from the stationary cymbal;

an operating rod connected with the movable cymbal, the operating rod being movable for moving the movable cymbal toward the stationary cymbal; biasing means for normally biasing the movable cymbal away from the stationary cymbal;

a foot pedal connectable with the operating rod, the pedal being movable in one direction to move the operating rod to move the movable cymbal to contact the stationary cymbal, and the biasing means also biasing the pedal opposite the one direction;

connecting means for connecting the pedal to the operating rod, the connecting means comprising a pedal initial height adjusting member connected between the pedal and the stand, the adjusting member having a selectively adjustable length for setting the initial height of the pedal while the movable cymbal is separated from the stationary cymbal and before the operator moves the pedal to move the movable cymbal into contact with the stationary cymbal.

2. The high hat stand of claim 1, wherein the connecting means further comprises a connecting element connected to the pedal at a first location on the connecting element, the pedal height adjusting member being connected with the connecting element at a second location on the connecting element spaced from the first location, and the connecting element being connected with the operating rod at a third location on the connecting element, such that movement of the pedal moves the connecting element and the operating rod connected to the connecting element, while adjustment of the pedal height adjusting member adjusts the orientation and position of the connecting element for establishing the pedal initial height.

3. The high hat stand of claim 2, wherein there is a greater length between the first location of the connection between the pedal and the connecting element and the second location of the connection between the height adjusting member and the connecting element and there is a shorter length between the second location and the third location of the connection between the operating rod and the connecting element.

4. The high hat stand of claim 2, wherein the connecting element comprises a lever which is pivotally connected to the pedal, pivotally connected to the height adjustment member, and pivotally connected to the operating rod, such that adjustment of the length of the pedal height adjusting member adjusts the pivot orientation of the lever and thereby adjusts the pedal initial height.

5. The high hat stand of claim 4, wherein the lever is a single lever element extending from the pedal past the connection to the operating rod and to the pedal height adjusting member.

6. The high hat stand of claim 4, wherein the lever is comprised of two separate arms, one of the arms being connected with the pedal and the other of the arms providing the connection to the operating rod, and the two arms of the lever being attached to the pedal height adjusting member.

7. The high hat stand of claim 2, wherein the connecting element comprises a rotatable wheel, the pedal height adjusting member is connected with the wheel to move up and down with the wheel, and means connecting the wheel and the pedal such that movement of the pedal both rotates the wheel and moves the wheel in the direction toward which the pedal is moving.

8. The high hat stand of claim 7, wherein the operating rod is also connected with the wheel and moves together with the wheel as the wheel is moved by movement of the pedal.

9. The high hat stand of claim 8, wherein the operating rod is connected to the wheel and the connection to the operating rod is radially inward of the wheel with respect to the means on the wheel for connecting the wheel and the pedal.

10. The high hat stand of claim 9, wherein the pedal height adjusting member is connected to the rotation axis of the wheel while the operating rod is connected to the wheel eccentrically of the rotation axis of the wheel.

11. The high hat stand of claim 2, wherein the pedal height adjusting member comprises a first arm connected to the connecting element and a second arm connected to the stand, and means on the first and second arms for cooperatingly adjusting the positions of the arms along each other for adjusting the length of the pedal height adjusting member for thereby adjusting the pedal height.

12. The high hat stand of claim 11, wherein the means on the first and second arms comprises a respective toothed rack along each of the first and second arms, and the pedal height is adjusted by selecting the position along each arm of the toothed rack with respect to the toothed rack of the other arm, and means for securing the first and second arms together in a selected position.

13. The high hat stand of claim 2, wherein the movable cymbal is supported above the stationary cymbal, and the pedal is so connected with the operating rod and the operating rod is so connected with the movable cymbal that movement of the pedal downward moves the operating rod to move the movable cymbal to contact the stationary cymbal.

* * * * *